United States Patent [19]

Schwarze

[11] Patent Number: 4,743,408

[45] Date of Patent: May 10, 1988

[54] DEVICE FOR INTRODUCING A GAS INTO LIQUID

[76] Inventor: Hans-Otto Schwarze, c/o. Hosch Fördertechnik GmbH, Königswall 16-18, D-4350 Recklinghausen, Fed. Rep. of Germany

[21] Appl. No.: 892,026

[22] PCT Filed: Oct. 28, 1985

[86] PCT No.: PCT/EP85/00571

§ 371 Date: Aug. 11, 1986

§ 102(e) Date: Aug. 11, 1986

[87] PCT Pub. No.: WO86/02577

PCT Pub. Date: May 9, 1986

[30] Foreign Application Priority Data

Oct. 27, 1984 [DE] Fed. Rep. of Germany ..... 3439464

[51] Int. Cl.[4] ..... B01F 3/04

[52] U.S. Cl. ..... 261/123; 261/DIG. 75

[58] Field of Search ..... 261/DIG. 75, DIG. 78, 261/121 R, 123

[56] References Cited

U.S. PATENT DOCUMENTS

| | | | |
|---|---|---|---|
| 3,946,948 | 3/1976 | Horlin . | |
| 4,044,079 | 8/1977 | Tveit | 261/DIG. 75 |
| 4,282,172 | 8/1981 | McKnight | 261/DIG. 75 |

FOREIGN PATENT DOCUMENTS

| | | |
|---|---|---|
| 035243 | 5/1986 | European Pat. Off. . |
| 166309 | 12/1905 | Fed. Rep. of Germany . |
| 3015788 | 10/1981 | Fed. Rep. of Germany . |
| 2397870 | 2/1979 | France . |
| 490108 | 6/1970 | Switzerland . |

OTHER PUBLICATIONS

Great Britain Water Pollution Research Board, 1959 Report, pp. 94–98, 261—Dig. 75.

Berns et al. Kansas State University Bulletin, vol. 46, No. 5, May 1962, Special Report 20, 261—Dig. 78.

C.R.C. Standard Mathematical Tables, Tenth Ed., pp. 342, 92, Cpr. 1955, Copy with Ex.

*Primary Examiner*—Tim Miles

*Attorney, Agent, or Firm*—Auslander & Thomas

[57] ABSTRACT

A device for continuously introducing a gas into a liquid, in connection with a flotation operation, a deinking unit or the like. The liquid issues from an endless annular gap (6) which does not have any internal obstacles whatever such as boundary walls or the like and, after absorbing the gas, flows into a radial diffuser (14) from which the liquid, enriched with gas bubbles, issues into the treatment container of the apparatus. Therefore, for a treatment tank of circular cross-section, a single gasification device which is disposed centrally in the vicinity of the bottom is sufficient. An optional swirl flow may be produced by suitable deflection in the region of the diffuser or in the chamber for the liquid, which is disposed upstream in the annular gap.

15 Claims, 3 Drawing Sheets

DEVICE FOR INTRODUCING A GAS INTO LIQUID

Figure 1:
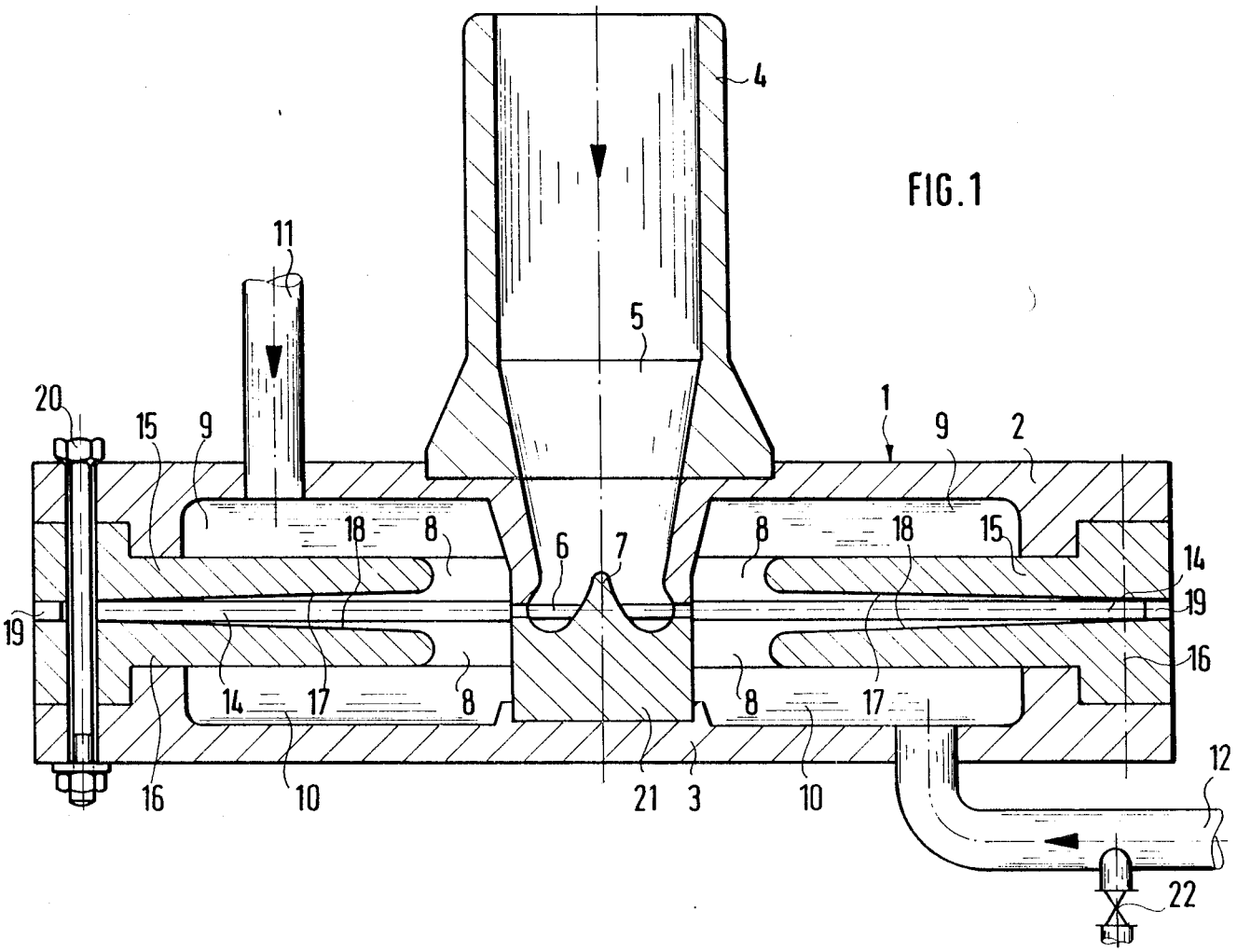

The invention relates to a device for continuously introducing a gas, in particular air, into a liquid, in particular water, for water activation and purification, flotation, deinking units or the like, comprising a liquid nozzle, one or more gas discharge openings downstream of the nozzle including the respective feed conduits, and a diffuser downstream of the gas discharge openings.

German laid-open application (DE-OS) No. 30 15 788 discloses, in a flotation apparatus, a gasification device of the kind set forth above. The actual device comprises a substantially parallelepipedic housing having a flat nozzle, a row of air feed openings and a flat diffuser with boundary surfaces which are flat in themselves. A plurality of gasification devices are used for a respective flotation apparatus, wherein a swirl effect is imparted to the liquid of the flotation chamber which is circular in cross-section, by virtue of inclined positioning of the gasification devices. The flat nozzle form was used primarily in order to counteract clogging due to fibre materials and the like, which has been observed hitherto in relation to round nozzles.

It has been found in practice however that the desired improvement in the form of a reduced risk of clogging is not achieved. More specifically, if clogging occurs adjacent a lateral boundary wall, an impenetrable plug is very quickly formed, extending as far as that wall, and that plug can no longer be automatically flushed away in the course of further operation. Instead, the flat nozzle slowly becomes closed and loses its advantageous operating conditions as for example the diffuser is too wide for the passage which is then still free, in the region of the liquid nozzle. Another major disadvantage of the known gasification devices however lies in the fact that they are relatively expensive to produce. The flat bodies which are required for the device must be produced to close tolerances on planing and grinding machines which experience has shown are less economical than for example shaping components by turning, as each cutting stroke movement involves an idle return movement.

Accordingly the problem of the present invention is so to improve a gasification device of the kind set forth in the opening part of this specification, that clogging is substantially avoided on the basis of the particular liquid nozzle, inexpensive manufacture is possible and the relatively complicated individual supply of a plurality of gasification devices is no longer necessary.

To solve that problem, the invention proposes that the liquid nozzle is in the form of a substantially circular annular gap with a horizontally extending central plane and the gas discharge openings are in the form of circular openings of a respective air chamber, which openings open above and below the annular gap, and that the diffuser comprises two mutually oppositely disposed boundary surfaces at respective sides of the liquid which issues from the annular gap and the mutual spacing of which, over a flow path from the interior outwardly, having regard to the increase in width due to the increasing peripheral area with increasing diameter, is so selected that the overall enlargement corresponds to that of a diffuser which is circular in cross-section, with an aperture angle of 2° to 6°.

The device according to the invention is thus provided with an endless annular nozzle in which there are no side boundary means in the form of a terminal wall or the like. Therefore, after an initially slight blockage at any point in the annular gap, there is no possibility of a bridge being formed to a stationary portion, which bridge can then no longer be eliminated by the running flow. On the contrary, the device according to the invention can provide that a blockage is broken up again immediately before it results in the flow conditions being perceptibly adversely affected. The device is produced by the assembly of turned components which are generally particularly economical and which can even be produced on automatic machines. Finally, the device only needs a single feed means for the liquid and for the gas in order to supply operating materials to the device according to the invention, which in any case is to be installed in flotation units of circular configuration.

European patent application No. 35 243 discloses a gasification device in which the jet of liquid is directed on to a pointed rotational body and in that way is deflected approximately into a horizontal direction. During deflection of the liquid or as the liquid passes from its point of discharge from the nozzle to the tip of the rotational body, the gas is added to the liquid, while the rotational body, together with the expanded air feed, forms a curved diffuser in which the flow is decelerated and its internal pressure is increased. Consequently transfer of the gas into the liquid is defective while in addition there is a disadvantageous relationship at the liquid nozzle between the peripheral surface and therewith the gas intake surface relative to the volume flow of the liquid, which also resists ample penetration of the gas into the liquid. Although in that kown device the mixture of liquid and gas is also discharged radially, in other respects however there are no points in common in relation to the device according to the invention.

In a radial diffuser as is used in the present invention, the flow path from the inside outwardly involves a natural expansion or enlargement effect, irrespective of the upper and lower boundary surfaces, which is due to the enlargement in diameter and the accompanying increase in peripheral surface area. It has now been found that a diffuser of that kind only provides the desired conversion of speed into pressure, with minimum levels of loss, when the overall expansion corresponds to that of a circular diffuser with an aperture angle of 2° to 6°. In view of that requirement, the device may have the widest range of configurations in regard to the upper and lower boundary surfaces relative to each other. With small amounts of liquid per unit of time, that is to say, when the annular gap is of a small peripheral length, the internal distance between the boundary surfaces decreases in an outward direction although obviously there is still, overall, an increase in size of the above-specified magnitude. In the case of annular gaps whose peripheral surface area is substantially greater in order to handle a larger amount of liquid per unit of time, with the operating length of the diffuser being otherwise approximately the same, the device may first haved a tapering configuration, then a uniform or constant configuration, and finally a configuration which increases in width, as between the two boundary surfaces.

A typical device in accordance with the invention is such that the annular gap has an inside width of 5 mm, the speed of discharge of the liquid from the annular gap is about 12 to 13 mm/s, and there is a sufficient discharge flow speed at the discharge of the diffuser with a head of liquid of about 1.5 to 2 mm in the treatment container. The last-mentioned parameter has been found to be advantageous for flotation operations and treatment containers of all kinds. In addition an inside width of 5 mm for the annular gap provides an adequate safeguard against clogging of the annular gap.

The device according to the invention is generally disposed in the centre of a container which is of circular cross-section, in the vicinity of the bottom thereof. If in that device there is to be a slight swirl or vortex flow within the container, it is possible to arrange low-resistance spacer arms between the boundary surfaces of the diffuser, the arms being slightly curved and producing an adequate degree of swirl. If the spacer arms are of a suitably full configuration, then, with or without curvature, they may be used for supplying the air chamber which is disposed therebelow with air from the air chamber which is disposed thereabove, while a pipe leads to the upper air chamber, the free end of the pipe being disposed above the surface of the liquid in the associated treatment container. In a different construction from that, it is also possible for the lower air chamber to be supplied by way of separate pipes or by way of connecting conduits outside the device, from the upper air chamber.

The supply to one air chamber from the other air chamber which is provided with a feed conduit may also be directly by way of the air discharge openings. To provide those transfer regions, the annular nozzle is then closed at predetermined locations by spacer portions or fixing portions, downstream of which, in the flow shadow thereof, is formed a liquid-free area which is used for transferring the gas from one chamber into the other. In general, it is sufficient to provide three spacer portions or fixing portions which are uniformly distributed around the periphery of the assembly, to produce such flow transfer areas. The width may possibly be varied in the peripheral direction of the annular gap.

The feed of liquid to the annular gap should be provided in a particularly careful fashion as, with the correct configuration, it is possible to make a considerable saving on operating running costs. Particularly advantageous conditions are achieved if the annular gap forms the discharge of a chamber, to the top side of which is connected the feed conduit for the liquid while the cross-section thereof decreases uniformly from the feed conduit to the annular gap. That is equivalent to the liquid being constantly accelerated as the respectively effective flow crosssection decreases from the feed location to the annular gap without any jump and without enlargement to a preceding dimension. Finally the annular gap forms the narrowest point from which the liquid is discharged at high speed.

Instead of the liquid being supplied at one side from below or from above, it is also possible to provide a feed of liquid on both sides, from below and from above. In that case the annular gap is disposed at the centre of a passage which is formed by the two liquid feed means. The last portion of each feed means, to the annular gap, can again be of a uniformly reducing configuration so that the liquid is uniformly accelerated and is discharged from the annular gap at high speed. It will be appreciated that, with that kind of arrangement in respect of the liquid feed, the same pressure must obtain in both feed conduits so that the one column of liquid can be 'supported' on the other.

Before the liquid passes into the diffuser, it absorbs extreme amounts of gas, as a result of the pressure falling sharply at that point, and that results in an increase in the volume of the liquid-gas mixture. Accordingly the inlet of the diffuser is markedly larger in cross-section than the annular gap. Generally the suction force of the liquid issuing from the annular gap is sufficient automatically to empty by suction, after the rest periods, the air chambers which have filled up by way of the openings.

Figure 2:
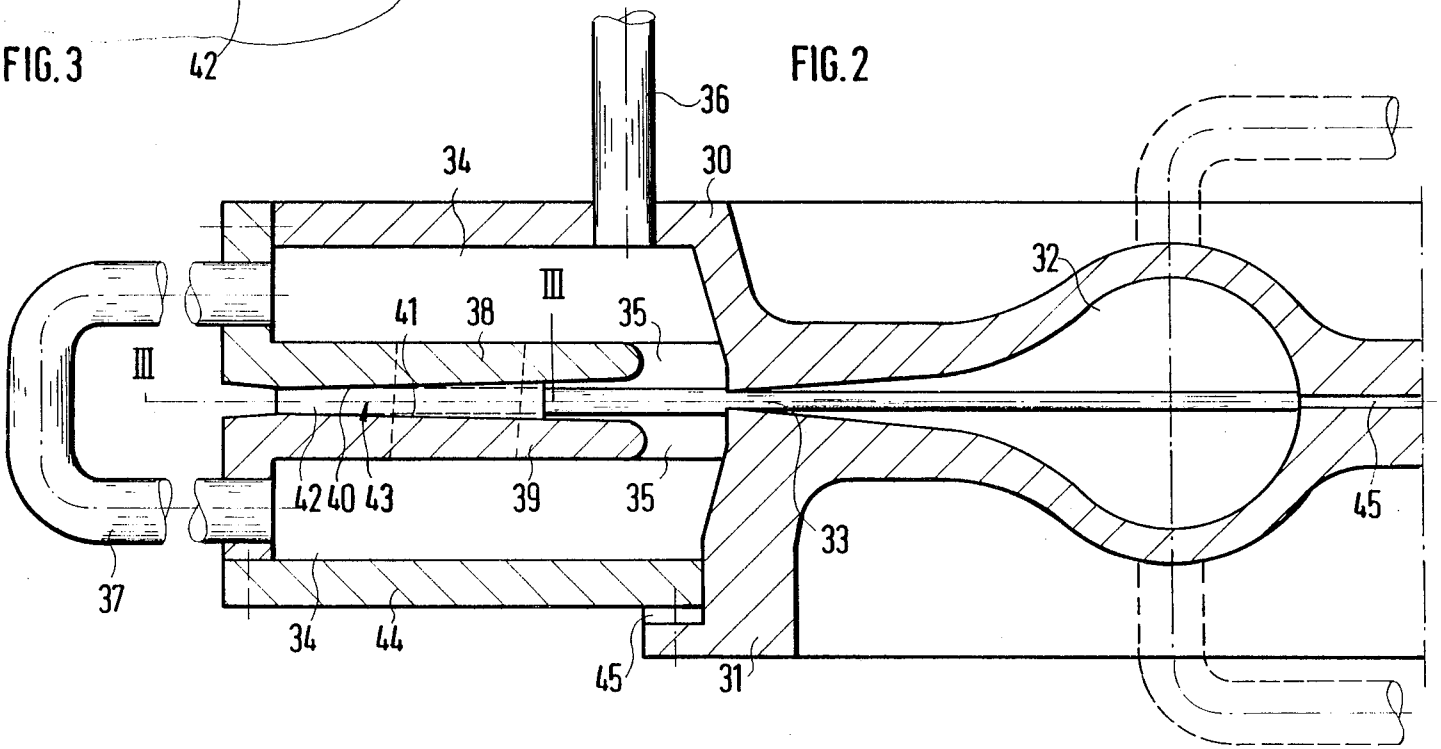
Figure 3:
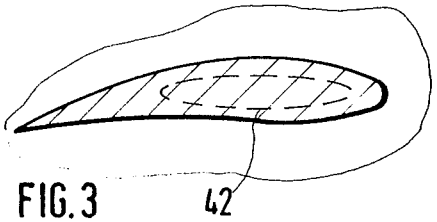
Figures 4, 5:
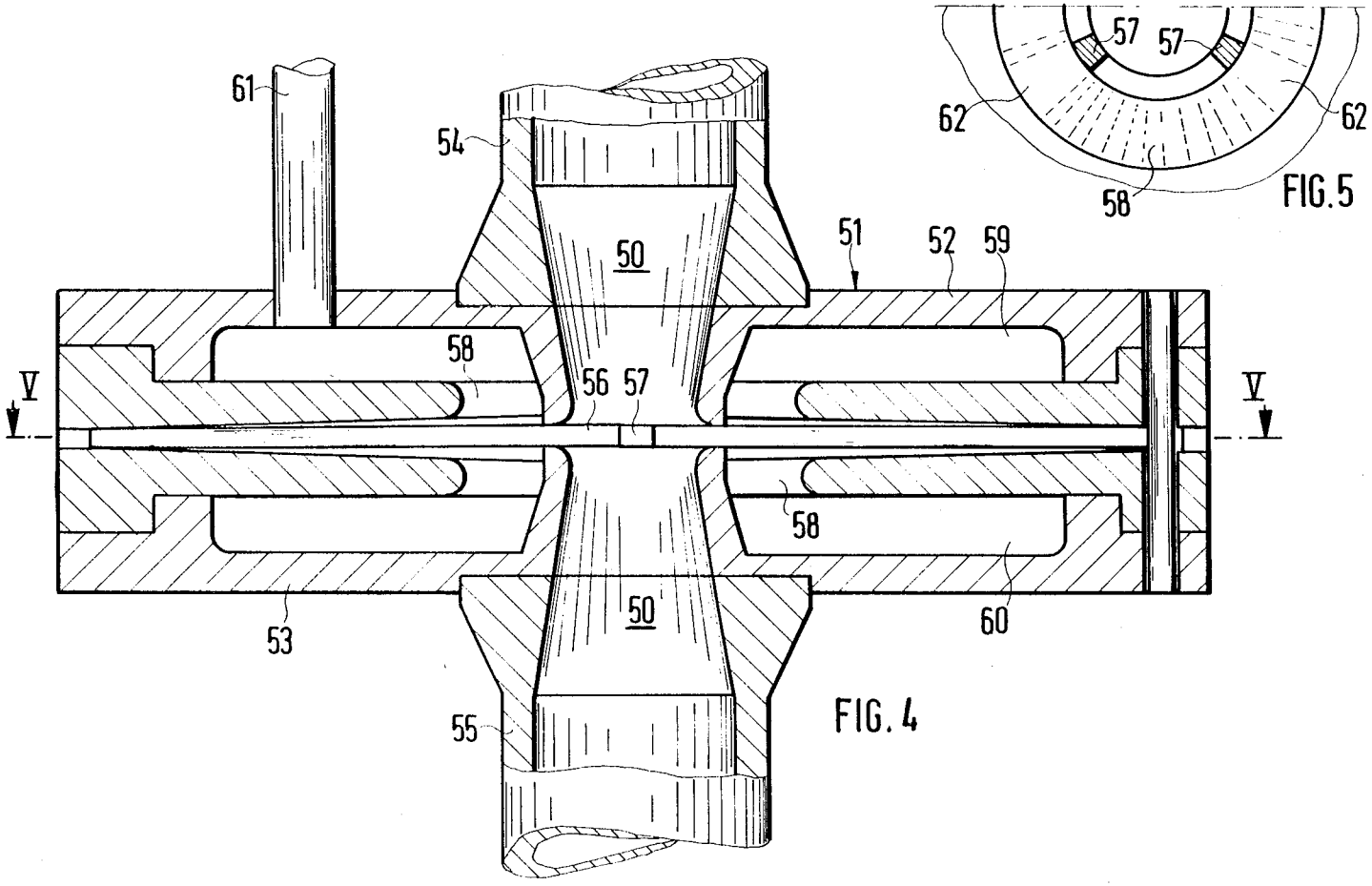

Embodiments of the invention are described in greater detail hereinafter and illustrated in the drawings in which:

FIG. 1 is a view in cross-section through a device according to the invention for smaller and medium liquid flow rates, FIG. 2 is a view corresponding to that shown in FIG. 1 of another embodiment of the invention for a very large flow rate, FIG. 3 shows a part of the FIG. 2 device in section taken along line III—III in FIG. 2, FIG. 4 is a view corresponding to that shown in FIG. 1 of another embodiment of the invention with a liquid feed conduit on the top side and on the underside, and FIG. 5 is a view in cross-section taken along line V—V in FIG. 4, showing part of the device, to illustrate the formation of regions for the transfer of gas from one chamber into the other.

The device according to the invention as shown in FIG. 1 essentially comprises a housing 1 formed from a top portion 2 and a bottom portion 3. Disposed in the centre of the top portion 2 is a feed means 4 for a liquid which is to be enriched with gas, for example for a flotation unit. The feed means 4 communicates with a chamber 5, the lower end of the feed means 4 already being a part of the cross-sectional reduction downstream of the chamber 5. The end of the chamber 5 is formed by an annular gap 6 to which the liquid flows, with a steady increase in speed. In that connection, a tip portion 7 in the middle of a bottom 21 of the chamber 5, said bottom being in the form of an annular trough, contributes to uniform distribution of the flow to the endless annular gap 6 which extends therearound.

The liquid issuing from the annular gap 6 flows past openings 8 into a diffuser 14, the openings 8 forming the discharge of air chambers 9 and 10 which are supplied with gas, being air in the present case, by way of feed conduits 11 and 12. In the region of the openings 8, the jet of liquid absorbs gas and the resulting increase in volume of the mixture which is now present is taken into consideration by virtue of a correspondingly enlarged inlet for the diffuser 14.

The boundary surfaces 17 and 18 of the diffuser 14 which is formed by two discs 15 and 16 converge slightly towards each other in an outward direction, although in all there is an increase in width for the medium flowing through the diffuser 14, more specifically by virtue of the increase in width in the peripheral direction, with increasing distance from the annular gap 6. Spacer portions 19 are distributed uniformly around the periphery of the diffuser 14, the two housing portions 2 and 3 being joined together in the direct vicinity of the spacer portions 19 by respective screw bolts 20 passing therethrough. Although the screw bolt 20 and, in the flow shadow thereof, the spacer portion 19, prevent discharge from the diffuser at three locations, that adverse effect on the flow can be tolerated without substantial losses.

The feed circuit 12 to the lower air chamber 10 must obviously extend up to a level which is above the surface of the liquid in the treatment container (not shown), in the centre of which and in the vicinity of the bottom of which the device illustrated in FIG. 1 is fitted. Otherwise, in the rest periods, the container would empty out by way of the opening 8, the lower air chamber 10 and the feed conduit 12. It may happen that the radial jet of liquid issuing from the annular gap 6 does not completely empty by suction the U-shaped portion of the feed conduit 12. For that reason, a valve 22 is provided at the lowest point of the U-shaped portion; when the installation is started up, the valve 22 is briefly opened and, when air has already been sucked in, through the feed conduit 12, the residual liquid which has accumulated there is discharged. Thereafter the valve 22 can be re-closed and does not need to be considered for the remaining period of operation of the installation.

The bottom 21 of the chamber 5 is replaceably fitted into the lower portion 3 of the housing, whereby in particular the width of the annular gap 6 and also the shape of the bottom of the chamber can be easily varied and adapted to different functions. If for example the tip portion 7 has a tendency to accumulate fibre materials or other impurities from the liquid, and thus there is the danger of the annular gap 6 becoming blocked, the bottom of the chamber 5 may be of a slightly curved configuration, in the manner of a watch glass, with the lowest point at the centre. The annular gap 6 may be varied by altering the thickness of the bottom 21. If in that connection the diffuser 14 is also to be varied, it is then possible to use spacer portions 19 of different thicknesses, with the bolts 20 being tightened to a different clamping length.

The embodiment illustrated in FIG. 2 is intended for a fairly high rate of liquid throughput, that is to say, for a larger installation, while the embodiment shown in FIG. 1 is provided for a substantially smaller installation with a much lower rate of liquid throughput. Corresponding differences are also to be found in the external dimensions, the precise dimensions depending on the liquid throughput and the selected speed of discharge in the annular gap. In other respects the two devices are very similar although, as a result of the higher level of throughput, there are also variations which will be described in particular detail hereinafter.

The top portion 30 and the bottom portion 31 of the housing co-operate in such a way as to provide therebetween an annular gap 33 which is fed from an annular chamber 32. The annular chamber 32 is of a substantially toric configuration, while there is, in a radially outward direction, an acceleration section which progressively decreases in width and which has its narrowest point in the annular gap 33. The annular chamber 32 is fed by a plurality of feed conduits which are preferably disposed in pairs in mutually opposite relationship and which are indicated in broken lines in FIG. 2. It will be appreciated that, in a different construction therefrom, it is possible to provide a central feed in the manner provided by the chamber 5 in FIG. 1.

Once again, disposed above and below the diffuser 43 are the air chambers 34, the outlets of which, in the form of openings 35, are disposed directly above and below the discharge of the annular gap 33. All the air is fed to the upper chamber 34 by way of a plurality of feed conduits 36 of which FIG. 2 shows only a single feed conduit 36, for the sake of clarity of the drawings. From there, a connecting conduit 37 leads to the lower air chamber 34. In that arrangement, the connecting conduit 37 extends approximately to the wall of the treatment container in which the device shown in FIG. 2 is disposed. That is indicated by broken lines within the connecting conduit 37. The device also has a plurality of connecting conduits 37 in order to ensure that the lower air chamber 34 is adequately supplied with gas.

The diffuser 43 is once again formed from two rings 38 and 39 which are bent over upwardly and downwardly respectively at their outer ends. In this embodiment, provided between the boundary surfaces 40 and 41 of the rings 38 and 39 are a plurality of spacer web portions or arms 42 which are uniformly distributed around the periphery of the assembly and which are of a particularly low-resistance configuration, and which hold the housing halves 30 and 31 and the associated parts of the housing at a spacing relative to each other.

If the spacer arms 42 are of a large-bellied configuration, they may be hollow and may provide for the transfer of air from the upper air chamber 34 into the lower air chamber 34, in addition to the connecting conduit 37 or in place thereof. Additionally or independently thereof, the spacer arms 42 may be operative to produce a swirl effect in the flow leaving the diffuser 43, more particularly by virtue of all spacer arms 42 being slightly curved in the same direction. FIG. 3 shows a view in cross-section through one of the swirl-generating spacer arms 42.

The internal width of the annular gap 33 may be adjusted by means of discs 45 which are disposed between the two housing portions 30 and 31 and between the bottom housing portion 31 and a further housing portion 44 which forms the bottom of the lower air chamber 34. The diffuser 43 may also be varied in regard to its profile and in regard to the spacing of its boundary surfaces 40 and 41 by exchanging the rings 38 and 39 and by varying the height of the spacer portions 43. In that way the device can be relatively quickly adapted to different uses.

After a period of stoppage, the two air chambers 34 as well as the feed conduit 36 are filled with liquid up to the level within the container in which the device shown in FIG. 2 is used. As soon as liquid issues from the annular gap 33 at high speed in the radial direction, by virtue of starting up a pump, a suction effect is produced in the region of the openings 35, so that initially further liquid is added to the jet of liquid issuing from the gap. When that occurs, the level of liquid in the feed conduit 36 and in all further feed conduits progressively drops until the upper air chamber 34 is filled with gas. From that time on, gas is already being metered into the liquid from the upper air chamber 34 by way of the associated opening 35 while liquid is still being transferred into the jet of liquid, through the lower air chamber 34. Even when the connecting conduits 37 have been completely emptied, there is still a certain residual amount of liquid remaining on the floor of the lower air chamber 34, and that can no longer be automatically eliminated, although it also does not cause any further interference with on-going operation of the device.

The embodiment illustrated in FIGS. 2 and 3 may also be produced virtually exclusively from turned components, which moreover also applies in regard to the embodiment shown in FIG. 1. The manufacturing costs are correspondingly low, and indirectly are still further reduced by virtue of the fact that there is a relatively central feed of the operating agents to the device, which makes it unnecessary to provide the usual distribution thereof along the periphery of a treatment container.

The actual device may be produced from steel, plastics material or an alloy, the choice of material being governed primarily by the corrosiveness of the medium to be handled. The flow speeds are at any event so selected, at the constructional design stage, that damage due to cavitation or the like is virtually excluded.

The speed of discharge of the liquid from the annular gap can be artificially increased by a swirl being superimposed on the radial flow direction, said swirl being generated within the chamber 5 or within the annular chamber 32. As a result of that, the pressure within the jet of liquid drops further so that even more gas penetrates into the liquid. The swirl flow is produced by baffle or guide members in the acceleration sections which exert a substantially low-loss effect, when of a suitable configuration.

FIG. 4 shows a further embodiment of a device according to the invention. The mode of operation is similar to that of the embodiment shown in FIG. 1, only the feed of liquid and the supply of air to a lower air chamber 60 being different. Therefore, FIG. 4 does not include any references relating to the diffuser as a description thereof would constitute repetition.

The upper portion 52 and the lower portion 53 of a housing 51 are respectively provided with an upper feed means 54 and a lower feed means 55 which together form a passage 50 in the vicinity of an annular gap 56. The passage uniformly decreases in diameter towards the annular gap 56 so that the liquid which flows into the assembly under the same pressure in the feed conduits 54 and 55 is accelerated in that region. It then passes at high speed out of the annular gap 56, past the openings 58, into the diffuser.

The upper portion 52 of the housing is provided with a feed conduit 61 for the gas, in particular air. Disposed at three locations (FIG. 5) in the annular gap 56 are spacer portions 57, which, at those locations, prevent the liquid from freely discharging from the annular gap 56. Liquid-free regions 62 are thus formed in the flow shadow behind the spacer portions 57 and provide for a transfer flow of air from the upper air chamber 59 into the lower air chamber 60. The flow is shown diagrammatically by means of broken lines in FIG. 5.

The embodiment shown in FIG. 4 is used in situations in which a feed conduit for the feed of liquid to the device from below is possible without difficulty. It will be appreciated that the embodiment shown in FIG. 1 may also be used in that situation, that embodiment then being mounted in the inverted position. Any man skilled in the art can then suitably deal with the appropriate laying or arrangement of the feed conduits 11 and 12 for the air.

The principle, which is shown in FIG. 5, relating to the transfer flow from one air chamber to the other by means of transfer regions in the flow shadow of the flow of liquid can obviously also be combined with the embodiment shown in FIG. 1 and the embodiment shown in FIG. 2; therefore that manner of supplying air for the air chamber which is remote from the feed conduit is not bound to the arrangement for feeding liquid at both sides.

The liquid which issues from the respective gap 6, 33 or 56 normally issues in a uniform flow without substantial turbulence. In the case of particularly wide annular gaps however, turbulence may increasingly occur, which is evidently conducive to the absorption of gas directly thereafter. In that case the diffuser intake must possibly be slightly enlarged, and thus converted to a kind of collecting or catch configuration. Excellent gasification results have also been achieved with such devices in accordance with the invention.

What is claimed is:

1. A device for continuously introducing a gas, in particular air, into a liquid, in particular water, for water activation and purification, flotation, deinking units or the like, comprising a fixed nozzle for the liquid, one or more gas discharge openings downstream of the nozzle communicating with gas feed conduits, and a diffuser downstream of the gas discharge openings, characterized in that said liquid nozzle is in the form of a substantially circular annular gap sized to accelerate liquid flow with a horizontally extending central plane and the gas discharge openings are in the form of annular openings of a respective air chamber, which openings open above and below the annular gap, and that the diffuser comprises two mutually oppositely disposed boundary surfaces at respective sides of the liquid which issues from the annular gap, and the mutual spacing of which, over a flow path from the interior outwardly, having regard to the enlargement due to the increasing peripheral area with increasing diameter, is so selected that the overall enlargement corresponds to that of a diffuser which is circular in cross-section, with an aperture angle of from 2° to 6°.

2. A device according to claim 1 characterised in that low-resistance spacer arms are disposed between the boundary surfaces of the diffuser.

3. A device according to claim 2 characterised in that the spacer arms are slightly curved to produce a swirl effect.

4. A device according to claim 1 characterised in that there is provided a feed conduit to the upper air chamber and that the two air chambers are in interchange relationship by way of a connecting conduit.

5. A device according to claim 1 characterised in that the annular gap is a component of an annular chamber having a plurality of uniformly peripherally distributed feed flows.

6. A device according to claim 1 characterised in that the boundary surfaces of the diffuser are held at a spacing relative to each other by means of a plurality of connecting conduits between the upper and lower air chambers.

7. A device according to claim 1 characterised in that the annular gap forms the discharge of a chamber to the top or underside of which is connected the feed conduit for the liquid and whose cross-section uniformly decreases from the feed conduit to the annular gap.

8. A device according to claim 7 characterised in that the bottom of the chamber is shaped to provide an annular trough.

9. A device according to claim 7 characterised in that the bottom of the chamber including the lower portion defining the annular gap, is releasably fixed in place.

10. A device according to claim 7 characterised in that disposed within the chamber are guide bodies which impart a swirl to the flow along the centre line.

11. A device according to claim 1, characterised in that the annular gap is closed at predetermined locations by spacer portions or fixing portions, that an air feed conduit goes only to the one air chamber, and that the regions of the annular openings, which are disposed in the flow shadow of the portions, serve as flow transfer locations for the air to flow into the other air chamber.

12. A device according to claim 1 characterised in that the annular gap forms the discharge of a passage to which respective feed conduits for the liquid are connected at the top side and at the underside.

13. A device according to claim 12 characterised in that the passage reduces uniformly on each feed flow side to the annular gap.

14. A device for continuously introducing a gas, in particular air, into a liquid, in particular water, for water activation and purification, flotation, deinking units or the like, comprising a fixed nozzle for the liquid, one or more gas discharge openings downstream of the nozzle communicating with gas feed conduits, and a diffuser downstream of the gas discharge openings, characterized in that said liquid nozzle is in the form of a substantially circular annular gap sized to accelerate liquid flow with a horizontally extending central plane and the gas discharge openings are in the form of annular openings of a respective air chamber, which openings open above and below the annular gap, and that the diffuser comprises two mutually oppositely disposed boundary surfaces at respective sides of the liquid which issues from the annular gap, and the mutual spacing of which, over a flow path from the interior outwardly, having regard to the enlargement due to the increasing peripheral area with increasing diameter, is so selected that the overall enlargement corresponds to that of a diffuser which is circular in cross-section, with an aperture angle of from 2° to 6°, and hollow low-resistance spacer arms are disposed between the boundary surfaces of the diffuser for connecting the air chambers, and each air chamber covers at least a part of the back side of the associated boundary surface.

15. The device according to claim 14 characterized in that the spacer arms are slightly curved to produce a swirl effect.

* * * * *